US011111770B2

(12) United States Patent
Ellis et al.

(10) Patent No.: US 11,111,770 B2
(45) Date of Patent: Sep. 7, 2021

(54) AUTOMATED STEERING USING OPERATING CONSTRAINTS

(71) Applicant: NABORS DRILLING TECHNOLOGIES USA, INC., Houston, TX (US)

(72) Inventors: Brian Ellis, Spring, TX (US); Scott Gilbert Boone, Houston, TX (US); Christopher Papouras, Houston, TX (US); Colin Gillan, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 529 days.

(21) Appl. No.: 15/961,633

(22) Filed: Apr. 24, 2018

(65) Prior Publication Data

US 2019/0323333 A1 Oct. 24, 2019

(51) Int. Cl.

| | |
|---|---|
| ***E21B 44/00*** | (2006.01) |
| ***E21B 47/024*** | (2006.01) |
| ***E21B 47/09*** | (2012.01) |
| ***E21B 7/04*** | (2006.01) |

(52) U.S. Cl.

CPC ..... *E21B 44/00* (2013.01); *E21B 7/04* (2013.01); *E21B 47/024* (2013.01); *E21B 47/09* (2013.01)

(58) Field of Classification Search

CPC ..... E21B 44/00; E21B 44/04; E21B 47/024; E21B 47/09; E21B 7/04; E21B 7/10; E21B 47/00; E21B 44/005; E21B 47/022; G05B 13/048; G05B 2219/24075

USPC ..... 73/152.03; 175/24, 40, 45; 324/333, 324/338; 702/6–7, 9, 11, 14, 182; 703/10

See application file for complete search history.

(56) References Cited

U.S. PATENT DOCUMENTS

| | | | |
|---|---|---|---|
| 8,210,283 | B1 | 7/2012 | Benson et al. |
| 8,596,385 | B2 | 12/2013 | Benson et al. |
| 8,996,396 | B2 | 3/2015 | Benson et al. |
| 9,157,309 | B1 | 10/2015 | Benson et al. |

(Continued)

FOREIGN PATENT DOCUMENTS

| | | |
|---|---|---|
| WO | 2016/054586 | 4/2016 |

*Primary Examiner* — Jeffrey P Aiello
(74) *Attorney, Agent, or Firm* — Haynes and Boone, LLP

(57) ABSTRACT

An apparatus and method of automatically altering proposed sliding instructions to comply with operating parameters is described. The method includes determining, by a surface steerable system ("SSS") and based on drilling operation information, a location of a BHA; determining, by the SSS and using the location of the BHA, a projected location of the BHA at a projected distance; determining if the projected location is within a location-tolerance window ("LTW") associated with the projected distance; creating, in response to the projected location not being within the LTW, proposed steering instructions that result in a proposed, projected BHA location being within the LTW that is associated with the projected distance; determining whether the proposed instructions comply with the operating parameters comprising a maximum slide distance; and altering, by the SSS, when the proposed steering instructions do not comply with the operating parameters, the proposed steering instructions to comply with operating parameters.

22 Claims, 10 Drawing Sheets

(56) References Cited

U.S. PATENT DOCUMENTS

| | | | | |
|---|---|---|---|---|
| 9,297,205 | B2 | 3/2016 | Benson et al. | |
| 9,404,356 | B2 | 8/2016 | Benson et al. | |
| 9,428,961 | B2 | 8/2016 | Benson et al. | |
| 2013/0032401 | A1* | 2/2013 | Edbury | E21B 21/01 175/24 |
| 2013/0140088 | A1* | 6/2013 | Williams | E21B 7/06 175/45 |
| 2014/0291023 | A1* | 10/2014 | Edbury | E21B 21/08 175/24 |
| 2014/0379133 | A1* | 12/2014 | Toma | E21B 44/00 700/275 |
| 2015/0000980 | A1* | 1/2015 | Williams | E21B 49/003 175/45 |
| 2015/0075274 | A1* | 3/2015 | Kpetehoto | E21B 47/007 73/152.48 |
| 2015/0377003 | A1 | 12/2015 | Benson et al. | |
| 2016/0160628 | A1* | 6/2016 | Sugiura | E21B 47/022 700/275 |
| 2016/0305230 | A1 | 10/2016 | Benson et al. | |
| 2016/0362971 | A1 | 12/2016 | Benson et al. | |
| 2017/0058656 | A1 | 3/2017 | Benson et al. | |
| 2018/0179823 | A1* | 6/2018 | Spatz | E21B 44/02 |
| 2019/0323333 | A1* | 10/2019 | Ellis | E21B 47/024 |

* cited by examiner

AUTOMATED STEERING USING OPERATING CONSTRAINTS

BACKGROUND

At the outset of a drilling operation, drillers typically establish a drilling plan that includes a target location and a drilling path, or well plan, to the target location. Once drilling commences, the bottom hole assembly is directed or "steered" from a vertical drilling path in any number of directions, to follow the proposed well plan. For example, to recover an underground hydrocarbon deposit, a well plan might include a vertical well to a point above the reservoir, then a directional or horizontal well that penetrates the deposit. The drilling operator may then steer the bit through both the vertical and horizontal aspects in accordance with the plan.

Conventionally, and when a drilling operator is provided sliding instructions by a computer system, the drilling operator draws on his or her past experiences and the performance of the well to proximate how to alter the proposed sliding instructions. This is a very subjective process that is performed by the drilling operator and that is based on his or her judgment. In some instances, the alteration of the sliding instructions by the drilling operator is not optimal. As a result, any one or more is a result: the tortuosity of the actual well path is increased, which increases the difficulty of running downhole tools through the wellbore and increases the likelihood of damaging any future casing that is installed in the wellbore; a slide segment is performed in a formation type in which a slide segment should not be performed, which may result in non-essential wear to drilling tools or unpredictable/undesirable drilling directions; the number of sliding instances is increased due to inefficient drilling segments or other reasons, which can increase the time and cost of drilling to target; and the actual drilling path differs significantly from the well plan. Thus, a method and apparatus for automatically altering proposed sliding instructions is needed.

SUMMARY OF THE INVENTION

A method is described that includes determining, by a surface steerable system and based on drilling operation information including feedback information, a location of a bottom hole assembly ("BHA"); determining, by the surface steerable system and using the location of the BHA, a projected location of the BHA at a projected distance; determining if the projected location is within a location-tolerance window associated with the projected distance; creating, in response to the projected location not being within the location-tolerance window and using the surface steerable system, proposed steering instructions that result in a proposed, projected BHA location being within the location-tolerance window that is associated with the projected distance; determining whether the proposed steering instructions comply with a plurality of operating parameters, wherein the plurality of operating parameters includes a maximum slide distance; and altering, by the surface steerable system, when the proposed steering instructions do not comply with the plurality of operating parameters, the proposed steering instructions to comply with the plurality of operating parameters. In some embodiments, the maximum slide distance is zero. In some embodiments, the plurality of operating parameters further includes a maximum dogleg severity; and determining whether the proposed steering instructions comply with the plurality of operating parameters includes determining whether the proposed steering instructions result in a proposed dogleg severity that is greater than the maximum dogleg severity. In some embodiments, the plurality of operating parameters further includes a shape of the location-tolerance window and a size of the location-tolerance window; and the location-tolerance window is defined by the shape of the location-tolerance window and the size of the location-tolerance window. In some embodiments, the plurality of operating parameters further includes an offset distance of the location-tolerance window relative to a target path; and the location-tolerance window is offset from the target path by the offset distance at the projected distance. In some embodiments, the plurality of operating parameters further includes an offset direction of the location-tolerance window relative to the target path; and the location-tolerance window is offset from the target path in the offset direction at the projected distance. In some embodiments, the plurality of operating parameters further includes an orientation-tolerance window including an inclination range and an azimuth range. In some embodiments, the method also includes determining, by the surface steerable system and based on the drilling operation information including the feedback information, an orientation of the BHA at the location; projecting, using the location and the orientation of the BHA, a projected BHA orientation at the projected distance; and determining if the projected BHA orientation is within the orientation-tolerance window at the projected distance; wherein creating the proposed steering instructions that result in the proposed, projected BHA location being within the location-tolerance window associated with the projected distance is in further response to the proposed, projected BHA orientation not being within the orientation-tolerance window at the projected distance; and wherein the proposed steering instructions also results in the proposed, projected BHA orientation being within the orientation-tolerance window that is associated the projected distance. In some embodiments, the plurality of operating parameters further includes unwanted downhole trend parameters that identify an unwanted downhole trend; wherein the method also includes: identifying, by the surface steerable system and based on the drilling operation information including the feedback information, an unwanted trend defined by the unwanted downhole trend parameters; wherein determining that the proposed steering instructions do not comply with the plurality of operating parameters includes determining that the proposed steering instructions are not associated with a reduction of the unwanted trend; and wherein altering the proposed steering instructions to comply with the plurality of operating parameters results in altered steering instructions that reduce the unwanted trend. In some embodiments, the unwanted downhole trend includes any one of: a trend associated with equipment output; a geological related trend; and a downhole parameter trend. In some embodiments, the plurality of operating constraints include: a first set of operating constraints associated with a first formation type; and a second set of operating constraints that are different from the first set of operating constraints and that are associated with a second formation type that is different from the first formation type; wherein the method further includes determining, by the surface steerable system and based on the drilling operation information including feedback information, that the location of BHA is within either the first formation type or the second formation type; and wherein altering, by the surface steerable system, the proposed steering instructions to comply with the plurality of operating constraints includes altering the proposed steering instructions to comply with the first set of operating constraints when the location of the BHA is within the first formation type and altering the proposed steering instructions by the surface steerable system, to comply with the second set of operating constraints when the location of the BHA is within the second formation type. In some embodiments, the method also includes implementing the altered steering instructions, using the surface steerable system, to drill a wellbore.

An apparatus is described that is adapted to drill a wellbore includes a bottom hole assembly ("BHA") including at least one measurement while drilling instrument; and a controller communicatively connected to the BHA and configured to: determine, based on drilling operation information including feedback information received from the BHA, a location of the BHA; determine, using the location of the BHA, a projected location of the BHA at a projected distance; determine if the projected location is within a location-tolerance window associated with the projected distance; create, in response to the projected location not being within the location-tolerance window, proposed steering instructions that result in a proposed, projected BHA location being within the location-tolerance window that is associated with the projected distance; determine whether the proposed steering instructions comply with a plurality of operating parameters, wherein the plurality of operating parameters includes a maximum slide distance; and alter, when the proposed steering instructions do not comply with the plurality of operating parameters, the proposed steering instructions to comply with the plurality of operating parameters. In some embodiments, the maximum slide distance is zero. In some embodiments, the plurality of operating parameters further includes a maximum dogleg severity; and the controller is further configured to determine whether the proposed steering instructions result in a proposed dogleg severity that is greater than the maximum dogleg severity. In some embodiments, the plurality of operating parameters further includes a shape of the location-tolerance window and a size of the location-tolerance window; and the location-tolerance window is defined by the shape of the location-tolerance window and the size of the location-tolerance window. In some embodiments, the plurality of operating parameters further includes an offset distance of the location-tolerance window relative to a target path; and the location-tolerance window is offset from the target path by the offset distance at the projected distance. In some embodiments, the plurality of operating parameters further includes an offset direction of the location-tolerance window relative to the target path; and wherein the location-tolerance window is offset from the target path in the offset direction at the projected distance. In some embodiments, the plurality of operating parameters further includes an orientation-tolerance window including an inclination range and an azimuth range. In some embodiments, the controller is further configured to: determine, based on drilling operation information including feedback information received from the BHA, an orientation of the BHA at the location; project, using the location and the orientation of the BHA, a projected BHA orientation at the projected distance; and determine if the projected BHA orientation is within the orientation-tolerance window at the projected distance; wherein the proposed steering instructions also result in the proposed, projected BHA orientation being within the orientation-tolerance window that is associated the projected distance. In some embodiments, the plurality of operating parameters further includes unwanted downhole trend parameters that identify an unwanted downhole trend; wherein the controller is further configured to: identify, based on drilling operation information including feedback information received from the BHA, an unwanted trend defined by the unwanted downhole trend parameters; determine that the proposed steering instructions are not associated with a reduction of the unwanted trend; and alter the proposed steering instructions to reduce the unwanted trend. In some embodiments, the unwanted downhole trend includes any one of: a trend associated with equipment output; a geological related trend; and a downhole parameter trend. In some embodiments, the plurality of operating constraints include: a first set of operating constraints associated with a first formation type; and a second set of operating constraints that are different from the first set of operating constraints and that are associated with a second formation type that is different from the first formation type; wherein the controller is further configured to, based on drilling operation information including feedback information received from the BHA, determine whether the location of BHA is within either the first formation type or the second formation type; and wherein the controller is further configured to alter the proposed steering instructions to comply with the first set of operating constraints when the location of the BHA is within the first formation type and alter the proposed steering instructions to comply with the second set of operating constraints when the location of the BHA is within the second formation type. In some embodiments, the controller is further configured to implement the altered steering instructions to drill the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
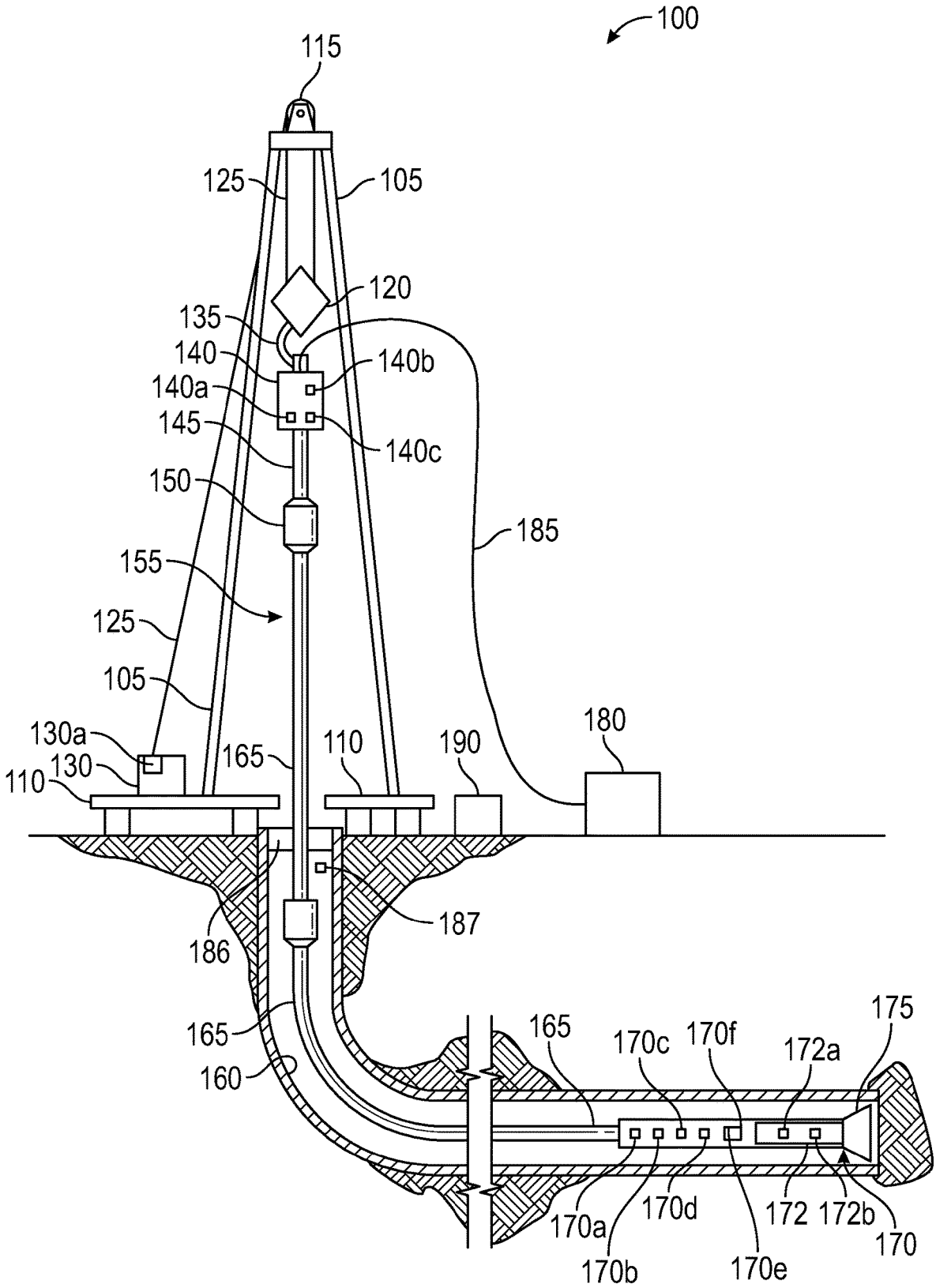
FIG. 1 is a schematic diagram of a drilling rig apparatus including a bottom hole assembly ("BHA") according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The apparatus and methods disclosed herein automate the alteration and execution of sliding instructions, resulting in increased efficiently and speed during slide drilling compared to conventional systems that require significantly more manual input or pauses to provide for input. Prior to drilling, a target location is typically identified and an optimal wellbore profile or planned path is established. Such target well plans are generally based upon the most efficient or effective path to the target location or locations. As drilling proceeds, the apparatus and methods disclosed herein determine the position of the BHA, create a slide drilling plan, which includes creating and/or altering sliding instructions to comply with one or more operating parameters, and execute the plan. Thus, the apparatus and methods disclosed herein automate the execution of sliding instructions.

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The drawworks 130 may include a rate of penetration ("ROP") sensor 130*a*, which is configured for detecting an ROP value or range, and a controller to feed-out and/or feed-in of a drilling line 125. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145, extending from the top drive 140, is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a BHA 170, and a drill bit 175. The bottom hole assembly 170 may include one or more motors 172, stabilizers, drill collars, and/or measurement-while-drilling ("MWD") or wireline conveyed instruments, among other components. The drill bit 175, which may also be referred to herein as a tool, is connected to the bottom of the BHA 170, forms a portion of the BHA 170, or is otherwise attached to the drill string 155. One or more pumps 180 may deliver drilling fluid to the drill string 155 through a hose or other conduit 185, which may be connected to the top drive 140.

The downhole MWD or wireline conveyed instruments may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

In the example embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may include a downhole annular pressure sensor 170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160, which may also be referred to as the casing pressure, downhole casing pressure, MWD casing pressure, or downhole annular pressure. These measurements may include both static annular pressure (pumps off) and active annular pressure (pumps on).

The apparatus 100 may additionally or alternatively include a shock/vibration sensor 170*b* that is configured for detecting shock and/or vibration in the BHA 170. The apparatus 100 may additionally or alternatively include a mud motor delta pressure (ΔP) sensor 172*a* that is configured to detect a pressure differential value or range across the one or more motors 172 of the BHA 170. In some embodiments, the mud motor ΔP may be alternatively or additionally calculated, detected, or otherwise determined at the surface, such as by calculating the difference between the surface standpipe pressure just off-bottom and pressure once the bit touches bottom and starts drilling and experiencing torque. The one or more motors 172 may each be or include a positive displacement drilling motor that uses hydraulic power of the drilling fluid to drive the bit 175, also known as a mud motor. One or more torque sensors, such as a bit torque sensor 172*b*, may also be included in the BHA 170 for sending data to a controller 190 that is indicative of the torque applied to the bit 175 by the one or more motors 172.

The apparatus 100 may additionally or alternatively include a toolface sensor 170*c* configured to estimate or detect the current toolface orientation or toolface angle. For the purpose of slide drilling, bent housing drilling systems may include the motor 172 with a bent housing or other bend component operable to create an off-center departure of the bit 175 from the center line of the wellbore 160. The direction of this departure from the centerline in a plane normal to the centerline is referred to as the "toolface angle." The toolface sensor 170*c* may be or include a conventional or future-developed gravity toolface sensor which detects toolface orientation relative to the Earth's gravitational field. Alternatively, or additionally, the toolface sensor 170*c* may be or include a conventional or future-developed magnetic toolface sensor which detects toolface orientation relative to magnetic north or true north. In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170. The apparatus 100 may additionally or alternatively include an inclination sensor 170*e* integral to the BHA 170 and configured to detect inclination at or near the BHA 170. The apparatus 100 may additionally or alternatively include an azimuth sensor 170*f* integral to the BHA 170 and configured to detect azimuth at or near the BHA 170. The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, the drawworks 130, the crown block 115, the traveling block 120, drilling line or dead line anchor may additionally or alternatively include or otherwise be associated with a WOB or hook load sensor 140*c* (WOB calculated from the hook load sensor that can be based on active and static hook load) (e.g., one or more sensors installed somewhere in the load path mechanisms to detect and calculate WOB, which can vary from rig-to-rig) different from the WOB sensor 170*d*. The WOB sensor 140*c* may be configured to detect a WOB value or range, where such detection may be performed at the top drive 140, the drawworks 130, or other component of the apparatus 100. Generally, the hook load sensor 140*c* detects the load on the hook 135 as it suspends the top drive 140 and the drill string 155.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

The apparatus 100 also includes the controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed near the mast 105 and/or other components of the apparatus 100. In an example embodiment, the controller 190 includes one or more systems located in a control room proximate the mast 105, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, and/or the pump 180 via wired or wireless transmission means which, for the sake of clarity, are not depicted in FIG. 1.

Figure 2:
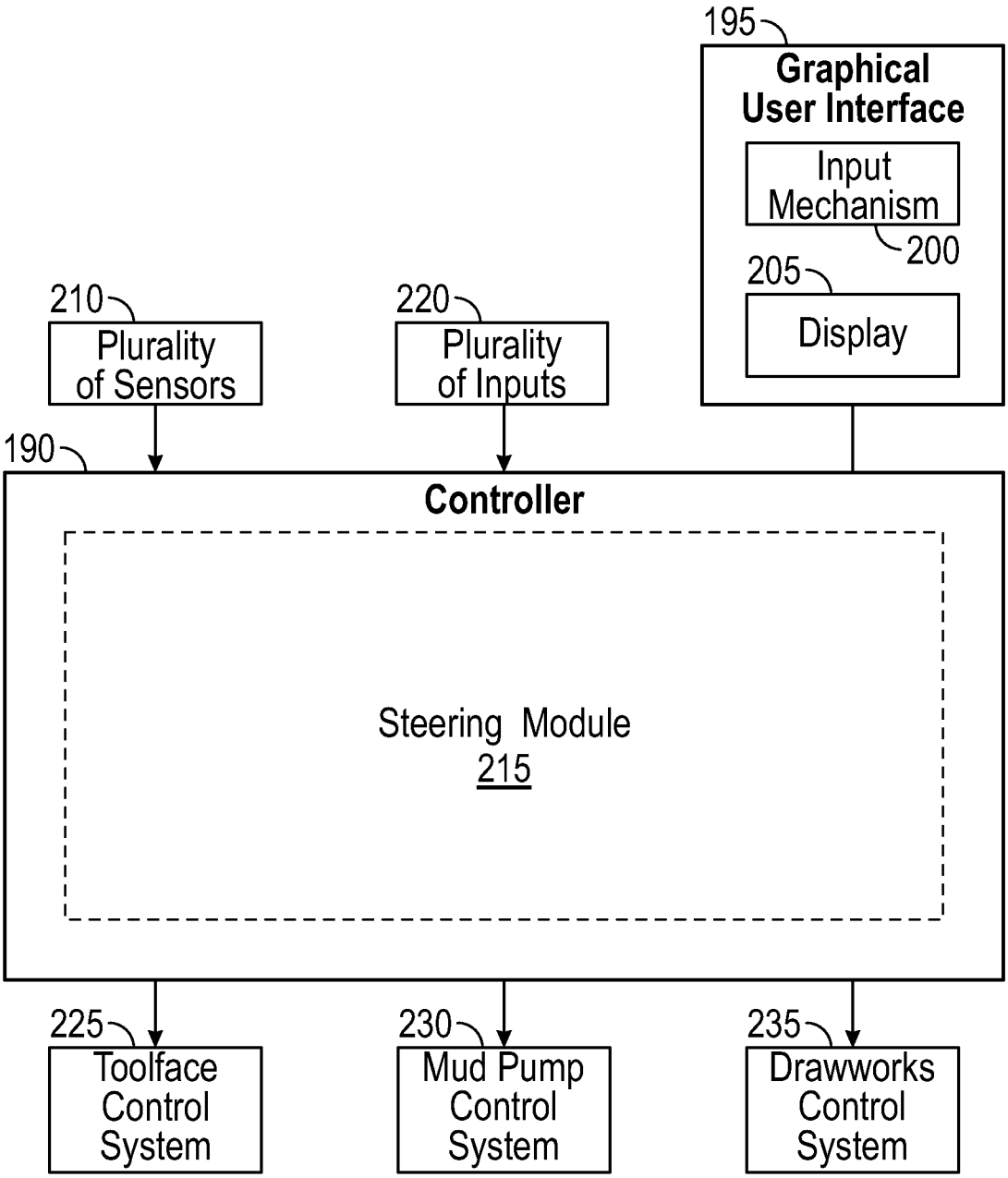
FIG. 2 is another schematic diagram of a portion of the drilling rig apparatus of FIG. 1, according to one or more aspects of the present disclosure.

FIG. 2 is a diagrammatic illustration of a data flow involving at least a portion of the apparatus 100 according to one embodiment. Generally, the controller 190 is operably coupled to or includes a GUI 195. The GUI 195 includes an input mechanism 200 for user-inputs. The input mechanism 200 may include a touch-screen, keypad, voice-recognition apparatus, dial, button, switch, slide selector, toggle, joystick, mouse, data base and/or other conventional or future-developed data input device. Such input mechanism 200 may support data input from local and/or remote locations. In general, the input mechanism 200 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 195 may also include a display 205 for visually presenting information to the user in textual, graphic, or video form. For example, the input mechanism 200 may be integral to or otherwise communicably coupled with the display 205. The GUI 195 and the controller 190 may be discrete components that are interconnected via wired or wireless means. Alternatively, the GUI 195 and the controller 190 may be integral components of a single system or controller. The controller 190 is configured to receive electronic signals via wired or wireless transmission means (also not shown in FIG. 1) from a plurality of sensors 210 included in the apparatus 100, where each sensor is configured to detect an operational characteristic or parameter. The controller 190 also includes a steering module 215 to control a drilling operation, such as a sliding operation or rotary steering operation. Often, the steering module 215 includes predetermined workflows, which include a set of computer-implemented instructions for executing a task from beginning to end, with the task being one that includes a repeatable sequence of steps that take place to implement the task. The steering module 215 generally implements the task of identifying drilling instructions. The steering module 215 also alters the drilling instructions and implements the drilling instructions to steer the BHA 170 along or towards the planned drilling path. The controller 190 is also configured to: receive a plurality of inputs 220 from a user via the input mechanism 200; and/or look up a plurality of inputs from a database. In some embodiments, the steering module 215 identifies and/or alters the drilling instructions based on downhole data received from the plurality of sensors 210 and the plurality of inputs 220. As shown, the controller 190 is also operably coupled to a toolface control system 225, a mud pump control system 230, and a drawworks control system 235, and is configured to send signals to each of the control systems 225, 230, and 235 to control the operation of the top drive 140, the mud pump 180, and the drawworks 130. However, in other embodiments, the controller 190 includes each of the control systems 225, 230, and 235 and thus sends signals to each of the top drive 140, the mud pump 180, and the drawworks 130. In some embodiments, a surface steerable system is formed by any one or more of: the plurality of sensors 210, the plurality of inputs 220, the GUI 195, the controller 190, the toolface control system 225, the mud pump control system 230, and the drawworks control system 235.

The controller 190 is configured to receive and utilize the inputs 220 and the data from the sensors 210 to continuously, periodically, or otherwise determine the location and orientation of the BHA 170 along with the current toolface orientation and make adjustments to the drilling operations in response thereto. The controller 190 may be further configured to generate a control signal, such as via intelligent adaptive control, and provide the control signal to the toolface control system 225, the mud pump control system 230, and/or the drawworks control system 235 to: adjust and/or maintain the BHA 170 location and/or orientation; to begin and/or end a slide drilling segment; to begin and/or end a rotary drilling segment; and to begin or end the process of adding a stand (i.e., two or three pipe segments coupled together) to the drill string 155. For example, the controller 190 may provide one or more signals to the toolface control system 225 and/or the drawworks control system 235 to increase or decrease WOB and/or quill position, such as may be required to accurately "steer" the drilling operation.

In some embodiments, the toolface control system 225 includes the top drive 140, the speed sensor 140*b*, the torque sensor 140*a*, and the hook load sensor 140*c*. The toolface control system 225 is not required to include the top drive 140, but instead may include other drive systems, such as a power swivel, a rotary table, a coiled tubing unit, a downhole motor, and/or a conventional rotary rig, among others.

In some embodiments, the mud pump control system 230 includes a mud pump controller and/or other means for controlling the flow rate and/or pressure of the output of the mud pump 180.

In some embodiments, the drawworks control system 235 includes the drawworks controller and/or other means for controlling the feed-out and/or feed-in of the drilling line 125. Such control may include rotational control of the drawworks (in v. out) to control the height or position of the hook 135, and may also include control of the rate the hook 135 ascends or descends. However, example embodiments within the scope of the present disclosure include those in which the drawworks-drill-string-feed-off system may alternatively be a hydraulic ram or rack and pinion type hoisting system rig, where the movement of the drill string 155 up and down is via something other than the drawworks 130. The drill string 155 may also take the form of coiled tubing, in which case the movement of the drill string 155 in and out of the hole is controlled by an injector head which grips and pushes/pulls the tubing in/out of the hole. Nonetheless, such embodiments may still include a version of the drawworks controller, which may still be configured to control feed-out and/or feed-in of the drill string.

Figure 3:
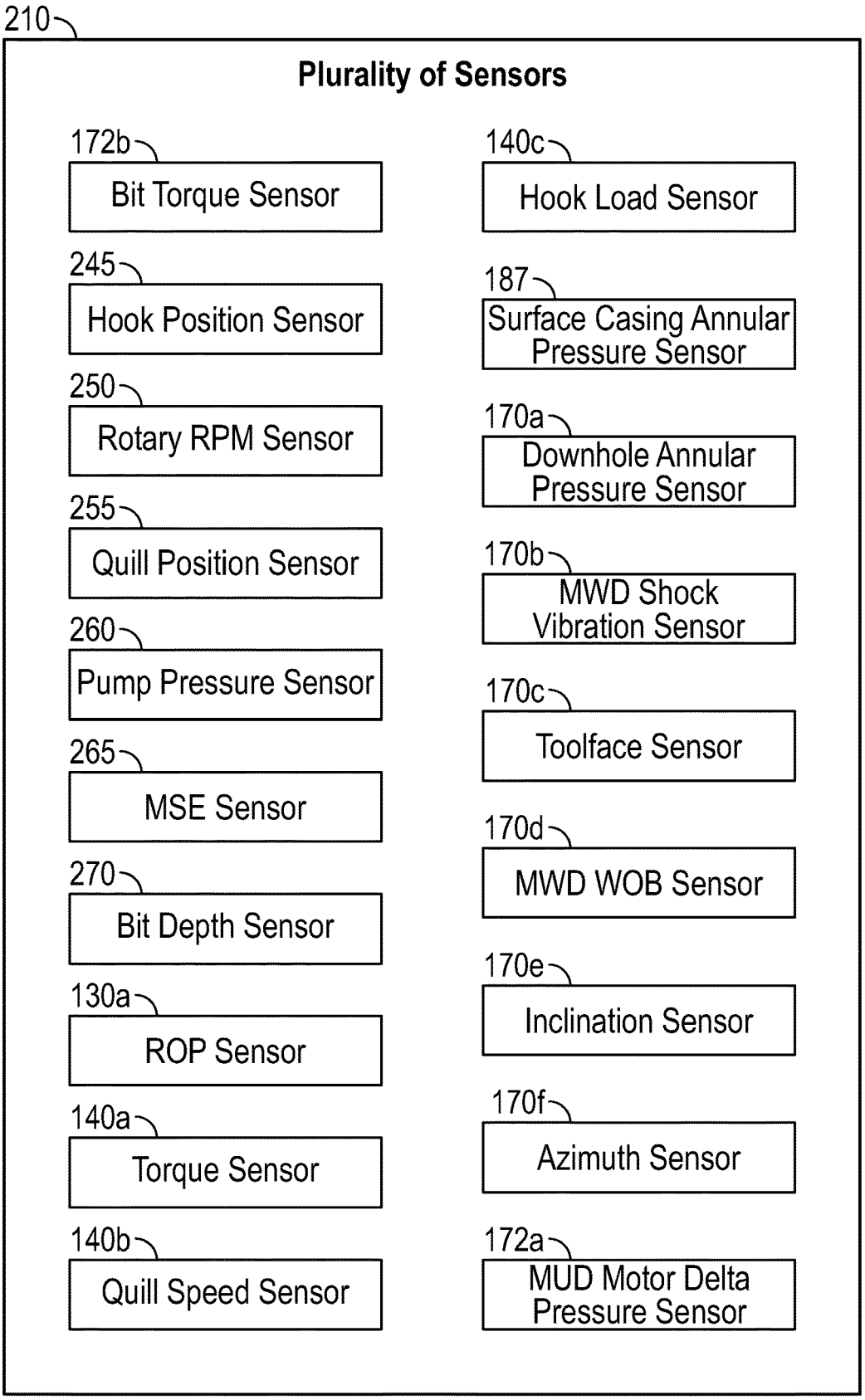
FIG. 3 is a diagrammatic illustration of a plurality of sensors, according to one or more aspects of the present disclosure.

As illustrated in FIG. 3, the plurality of sensors 210 may include the ROP sensor 130*a*; the torque sensor 140*a*; the quill speed sensor 140*b*; the hook load sensor 140*c*; the surface casing annular pressure sensor 187; the downhole annular pressure sensor 170*a*; the shock/vibration sensor 170*b*; the toolface sensor 170*c*; the MWD WOB sensor 170*d*; the inclination sensor 170*e*; the azimuth sensor 170*f*; the mud motor delta pressure sensor 172*a*; the bit torque sensor 172*b*; a hook position sensor 245; a rotary RPM sensor 250; a quill position sensor 255; a pump pressure sensor 260; a MSE sensor 265; a bit depth sensor 270; and any variation thereof. The data detected by any of the sensors in the plurality of sensors 210 may be sent via electronic signal to the controller 190 via wired or wireless transmission. The functions of the sensors 130*a*, 140*a*, 140*b*, 140*c*, 187, 170*a*, 170*b*, 170*c*, 170*d*, 170*e*, 170*f*, 172*a*, and 172*b* are discussed above and will not be repeated here. In some embodiments, the plurality of sensors 210 collect and provide data, or feedback information, to the controller 190.

Generally, the hook position sensor 245 is configured to detect the vertical position of the hook 135, the top drive 140, and/or the travelling block 120. The hook position sensor 245 may be coupled to, or be included in, the top drive 140, the drawworks 130, the crown block 115, and/or the traveling block 120 (e.g., one or more sensors installed somewhere in the load path mechanisms to detect and calculate the vertical position of the top drive 140, the travelling block 120, and the hook 135, which can vary from rig-to-rig). The hook position sensor 245 is configured to detect the vertical distance the drill string 155 is raised and lowered, relative to the crown block 115. In some embodiments, the hook position sensor 245 is a drawworks encoder, which may be the ROP sensor 130*a*.

Generally, the rotary RPM sensor 250 is configured to detect the rotary RPM of the drill string 155. This may be measured at the top drive 140 or elsewhere, such as at surface portion of the drill string 155.

Generally, the quill position sensor 255 is configured to detect a value or range of the rotational position of the quill 145, such as relative to true north or another stationary reference.

Generally, the pump pressure sensor 260 is configured to detect the pressure of mud or fluid that powers the BHA 170 at the surface or near the surface.

Generally, the MSE sensor 265 is configured to detect the MSE representing the amount of energy required per unit volume of drilled rock. In some embodiments, the MSE is not directly sensed, but is calculated based on sensed data at the controller 190 or other controller.

Generally, the bit depth sensor 270 detects the depth of the bit 175.

In some embodiments the toolface control system 225 includes the torque sensor 140*a*, the quill position sensor 255, the hook load sensor 140*c*, the pump pressure sensor 260, the MSE sensor 265, and the rotary RPM sensor 250, and a controller and/or other means for controlling the rotational position, speed and direction of the quill or other drill string component coupled to the drive system (such as the quill 145 shown in FIG. 1). The toolface control system 225 is configured to receive a top drive control signal from the steering module 215, if not also from other components of the apparatus 100. The top drive control signal directs the position (e.g., azimuth), spin direction, spin rate, and/or oscillation of the quill 145.

In some embodiments, the drawworks control system 235 comprises the hook position sensor 245, the ROP sensor 130*a*, and the drawworks controller and/or other means for controlling the length of drilling line 125 to be fed-out and/or fed-in and the speed at which the drilling line 125 is to be fed-out and/or fed-in.

In some embodiments, the mud pump control system 230 comprises the pump pressure sensor 260 and the motor delta pressure sensor 172*a*.

Figure 4:
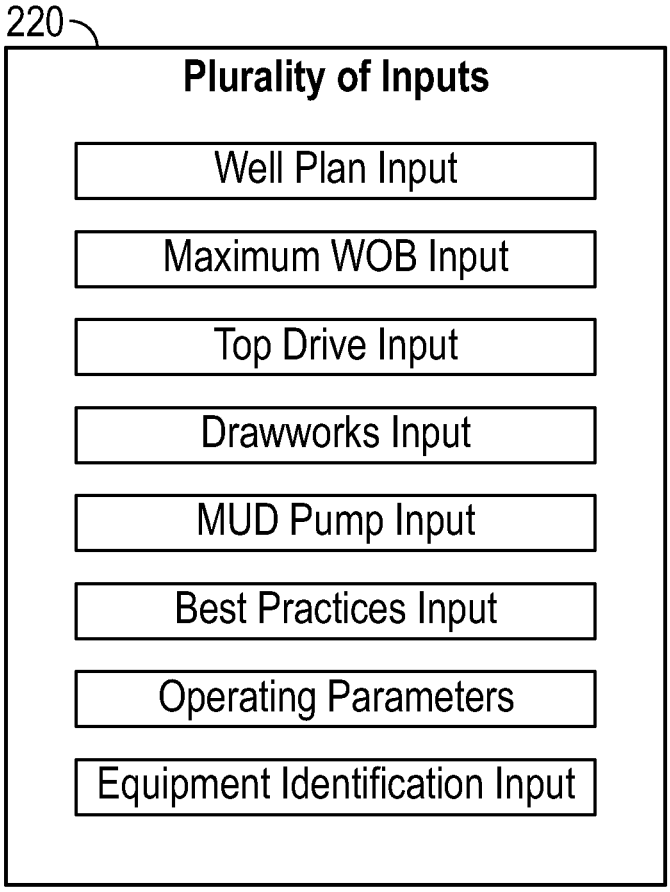
FIG. 4 is a diagrammatic illustration of a plurality of inputs, according to one or more aspects of the present disclosure.

As illustrated in FIG. 4, the plurality of inputs 220 may include well plan input, a maximum WOB input, a top drive input, a drawworks input, a mud pump input, a best practices input, operating parameters such as for example a plurality of operating parameters associated with a first formation type and a plurality of operating parameters associated with a second formation type, and equipment identification input. In some embodiments, the plurality of inputs 220 forms at least a portion of drilling operation information.

Figure 5A:
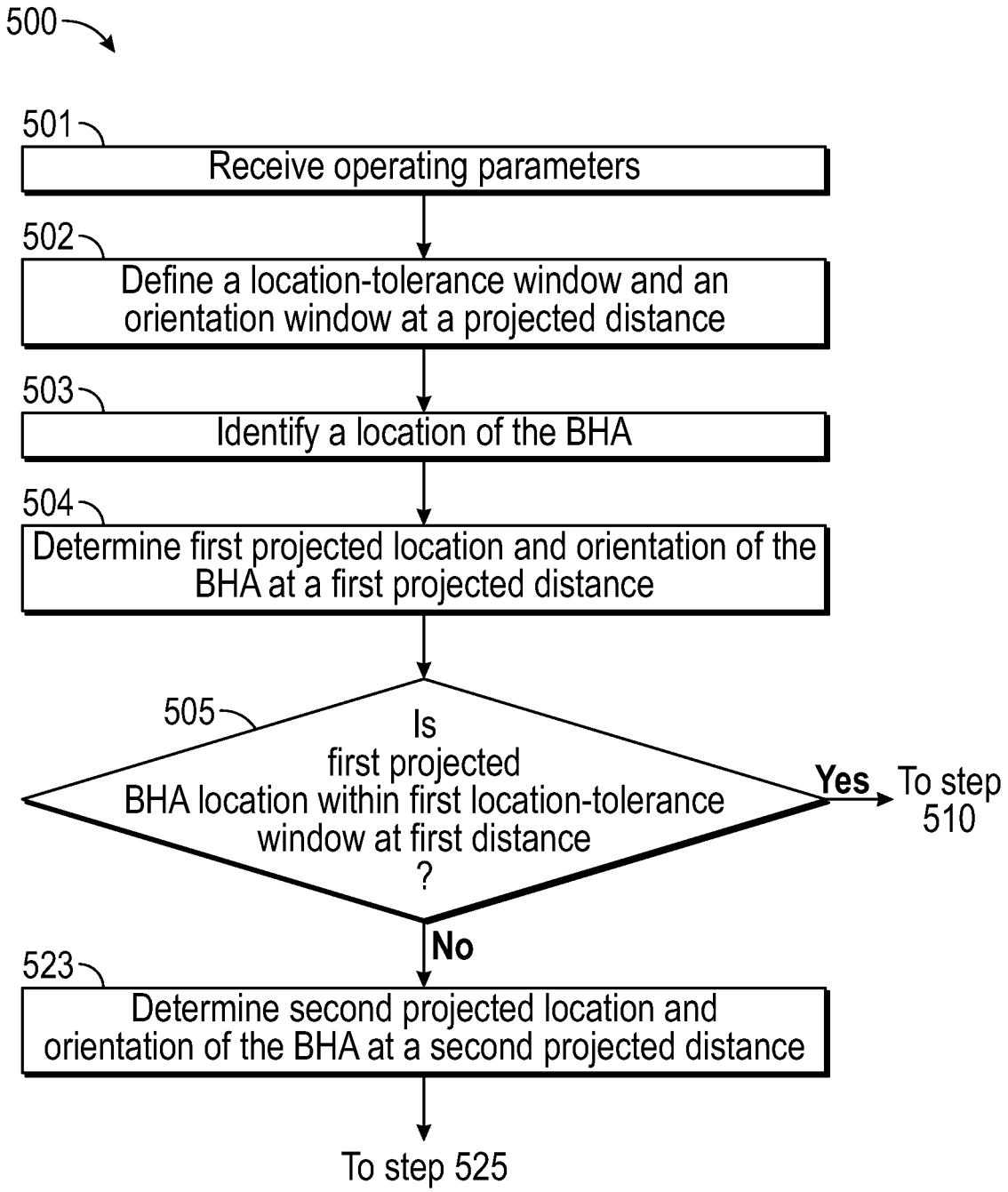
FIGS. 5A, 5B, and 5C together form a flow-chart diagram of a method according to one or more aspects of the present disclosure.
Figure 5B:
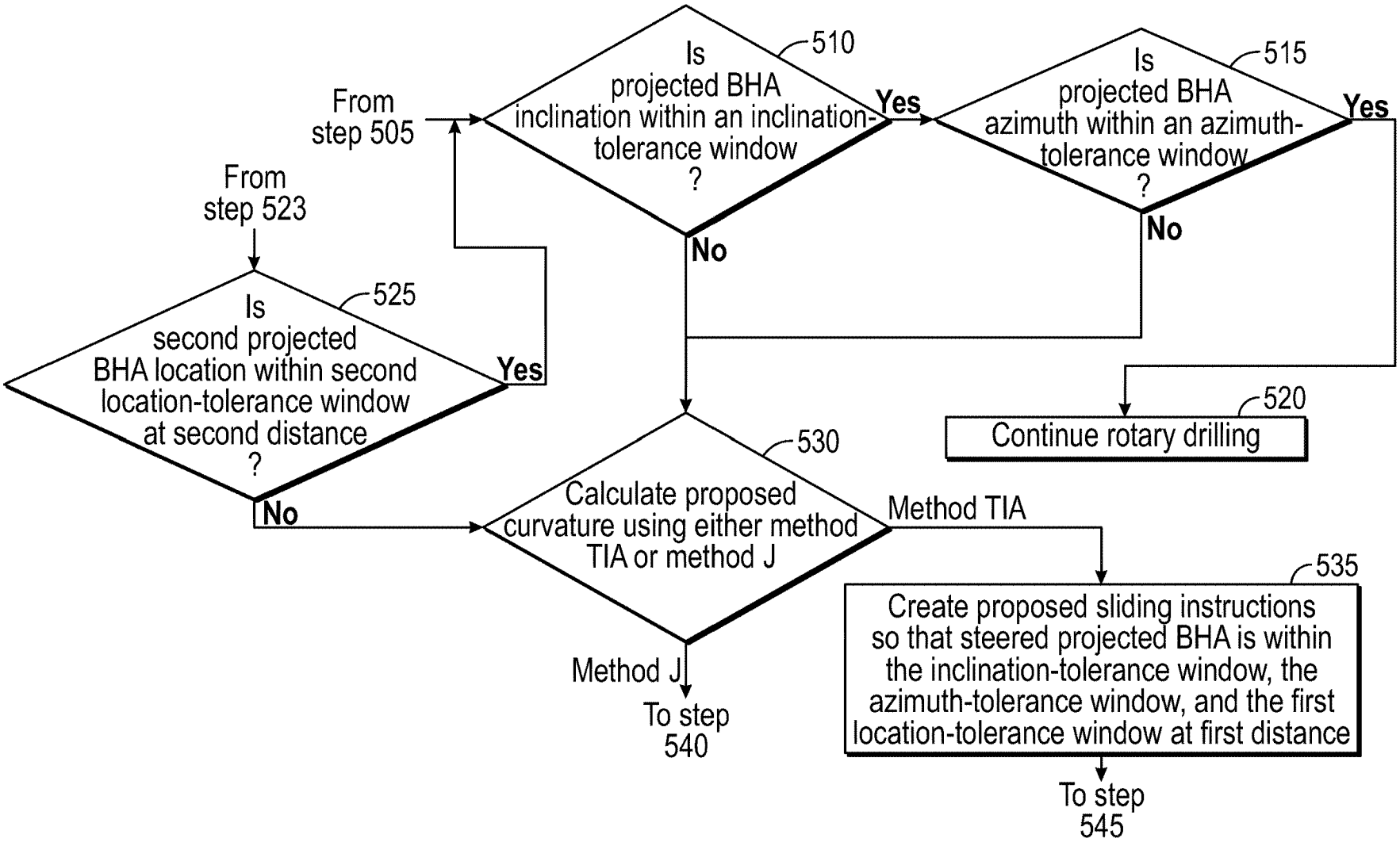
Figure 5C:
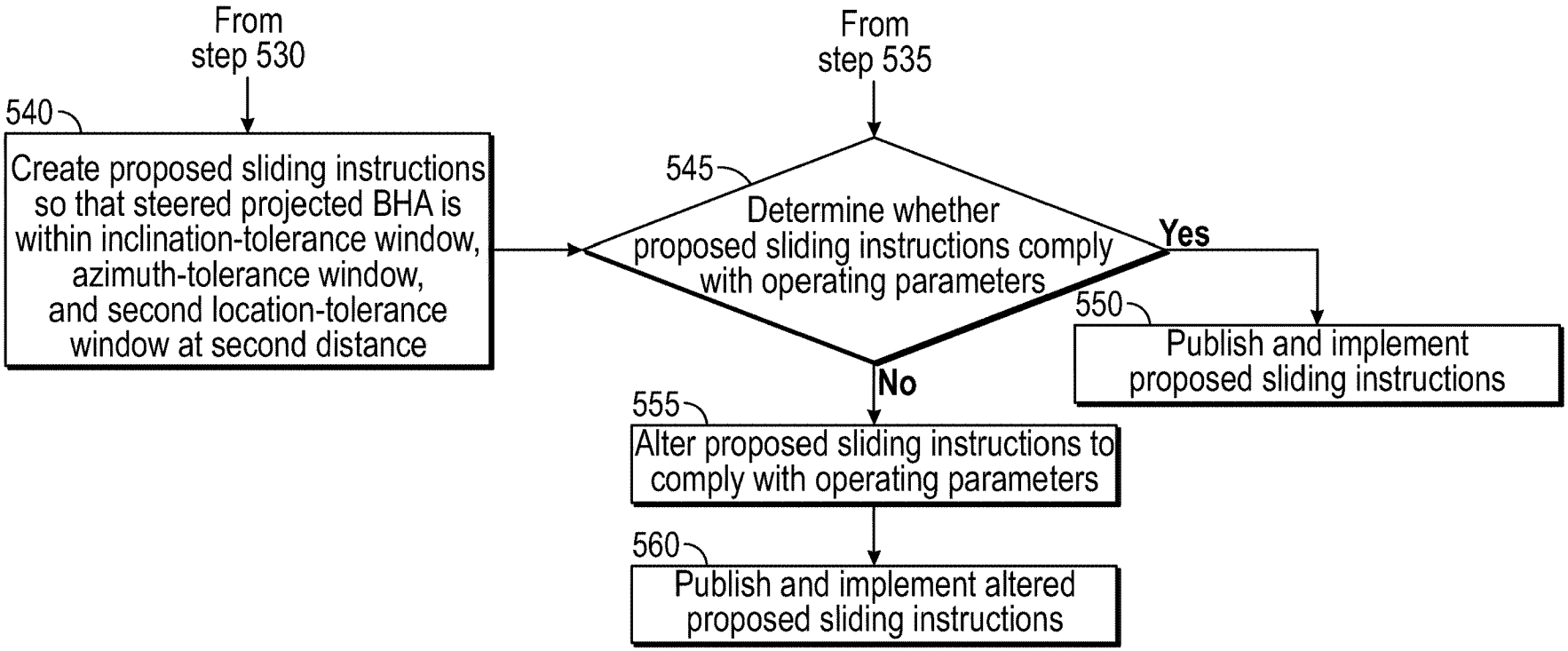

In an exemplary embodiment, as illustrated in FIGS. 5A-5C with continuing reference to FIGS. 1-4, a method 500 of operating the apparatus 100 includes receiving operating parameters at step 501; defining a location-tolerance window ("LTW") and an orientation-tolerance window ("OTW") at a projected distance at step 502; identifying a location of the BHA 170 at step 503; determining a first projected location and orientation (e.g., inclination and azimuth) of the BHA 170 at a first projected distance at step 504; determining if the first projected BHA location is within a first LTW at a first distance at step 505, if yes, then determining if the projected BHA inclination is within an inclination-tolerance window at step 510, if yes, then determining if the projected BHA azimuth is within an azimuth tolerance window at step 515, and if yes, then continuing rotary drilling at step 520. If the first projected BHA location is not within the first LTW at the first distance at step 505, then the method 500 includes determining a second projected location and orientation of the BHA 170 at a second projected distance at step 523; and determining if the second projected BHA location is within a second LTW at the second projected distance at step 525. If yes, then the next step is 510. If no, then the next step is determining whether to calculate a proposed curvature using a "TIA method" or a "J method" at step 530. Generally, the TIA method is based on the true vertical depth, inclination, and azimuth of the BHA 170 and generally results in a proposed path that runs parallel to the target well plan. Generally, the J method results in a proposed path that curves toward the target well plan to intersect the target well plan. If the TIA method is to be used, then the method includes creating proposed sliding instructions—based on the calculated proposed curvature from the TIA method—so that the steered projected BHA is within the inclination-tolerance window, the azimuth-tolerance window, and the first LTW at the first distance at step 535. If the J Method is to be used, then the method 500 includes creating proposed sliding instructions—based on the calculated proposed curvature from the J method—so that the steered projected BHA is within the inclination-tolerance window, the azimuth-tolerance window, and a second LTW at the second distance at step 540. After either step 535 or 540, the method 500 further includes determining whether the proposed sliding instructions comply with a plurality of operating constraints at step 545. If yes, then the proposed sliding instructions are published and implemented at step 550. If no, then the proposed sliding instructions are altered to comply with the plurality of operating constraints at step 555 and then the altered proposed sliding instructions are published and implemented at step 560.

Figure 6:
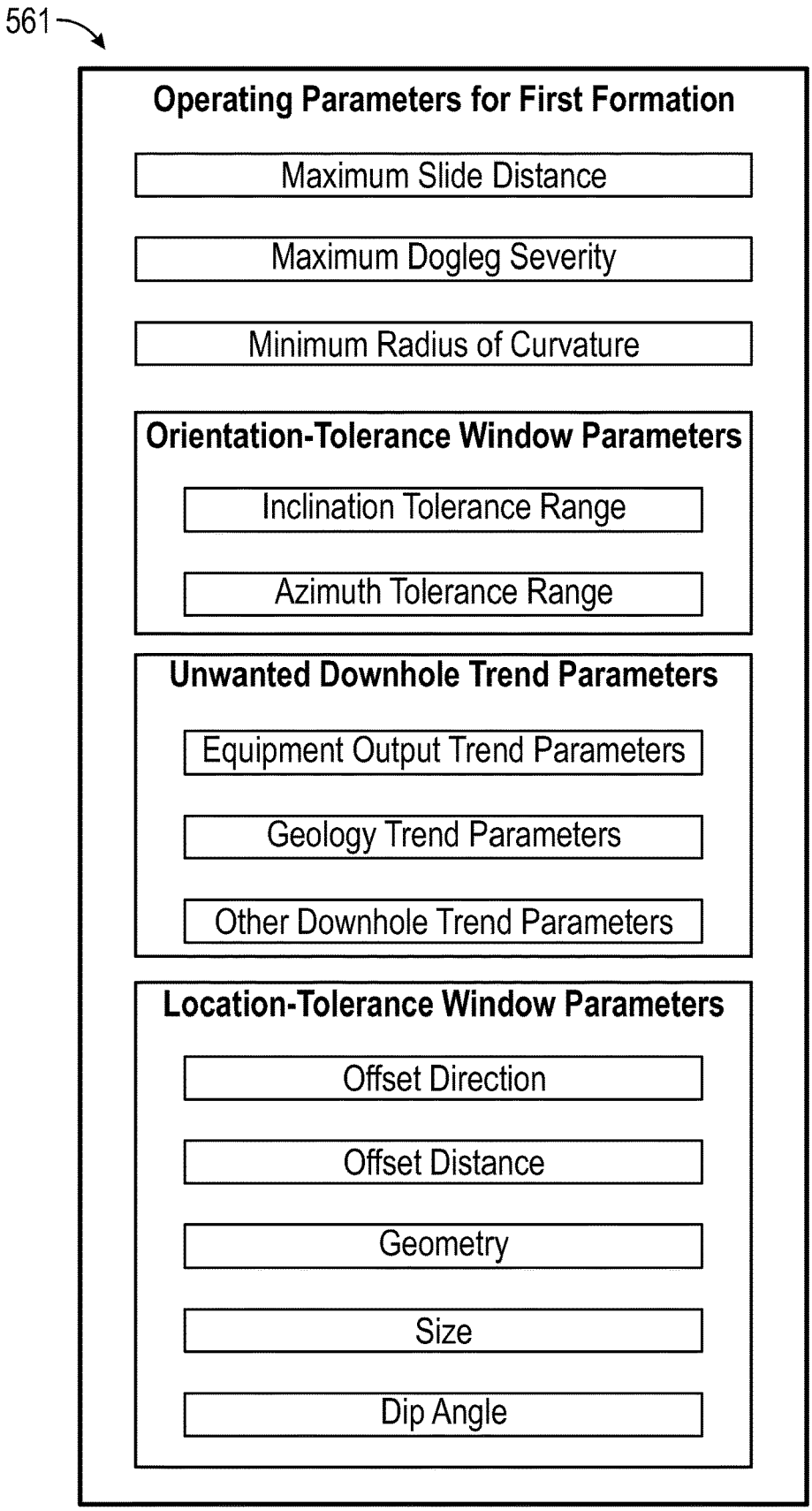
FIG. 6 is a diagrammatic illustration of a plurality of operating parameters for a first formation, according to one or more aspects of the present disclosure.

At the step 501, the operating parameters are received. The operating parameters may be received by the controller 190 via the GUI 195, via a wireless connection to another computing device, or via any other means. As illustrated in FIG. 6, a plurality of operating parameters 561 associated with the first formation type may include a maximum slide distance; a maximum dogleg severity; and a minimum radius of curvature. The plurality of operating parameters also includes orientation-tolerance window parameters, such as an inclination tolerance range and an azimuth tolerance range. The plurality of operating parameters also includes parameters that define an unwanted downhole trend, such as an equipment output trend parameters, geology trend parameters, and other downhole trend parameters. The plurality of operating parameters also includes LTW parameters, such as an offset direction, an offset distance, geometry, size, and dip angle.

In some embodiments, the maximum slide distance may be zero. That is, no slides are recommended while the BHA 170 extends within the first formation type or during a specific period of time relative to the drilling process. The maximum slide distance is not limited to zero feet, but may be any number of feet or distance, such as for example 10 ft., 20 ft., 30 ft., 40, ft. 50 ft., 90 ft., etc.

Generally, the maximum dogleg severity is the change in inclination over a distance and measures a build rate on a micro-level (e.g., 3°/100 ft.) while the minimum radius of curvature is associated with a build rate on a macro-level (e.g., 1°/100 ft.).

The orientation-tolerance window parameters include an inclination tolerance range and an azimuth tolerance range. In some embodiments, the inclination tolerance range and the azimuth tolerance range are associated with a location along the well plan and change depending upon the location along the well plan. That is, at some points along the well plan the inclination tolerance range and the azimuth tolerance range may be greater than the inclination tolerance range and the azimuth tolerance range along other points along the well plan.

In some embodiments, the steering module 215 detects a trend, which may include any one or more of an equipment output trend; a formation/geology related trend; and other downhole trends. An example of an equipment output trend includes, for example, a motor output trend, or other trend relating to the operation of a piece of equipment. An example of the formation related trend may include, for example, a trend relating to pore pressure. An example of other downhole trends is a downhole parameter trend, such as for example a trend relating to differential pressure. Another example of the other downhole trends is a BHA location and/or orientation trend. An example of the BHA location and/or orientation trend may include a trend that the location of the BHA 170 is inching closer to an edge or boundary of the LTW or the OTW.

Figure 7:
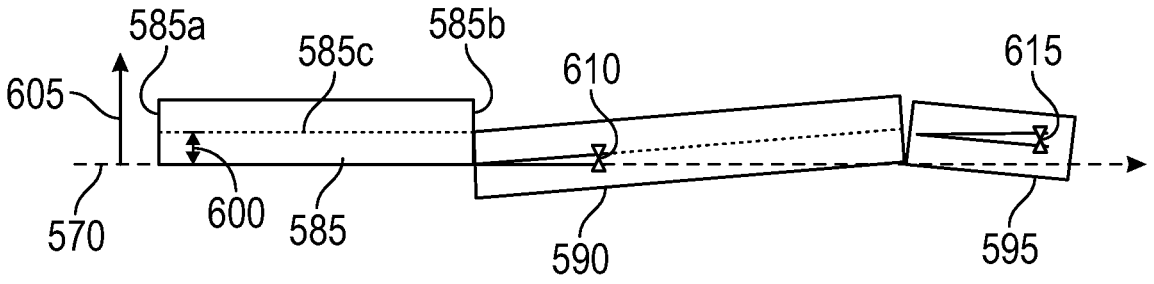
FIG. 7 is a diagrammatic illustration of tolerance windows during a step of the method of FIGS. 5A-5C, according to one or more aspects of the present disclosure.

As illustrated in FIG. 7, the location-tolerance window parameters define the location-tolerance window at points along the well plan. As the LTWs extend along all, or portions, of the well plan, tolerance cylinders or tubulars are formed. As shown, tolerance tubulars or windows 585, 590, and 595 extend along the target path or well plan 570. Each has a beginning portion such as portion 585*a*, an ending portion such as portion 585*b*, and a longitudinal axis such as axis 585*c*. As shown, the longitudinal axis 585*c* of the window 585 is offset from the target well plan 570 by a distance 600, in a direction 605, and a dip angle of zero. The beginning portion of the window 590 is not offset from the target well plan 570 but the end portion is offset from the target well plan 570 due to the window 590 having a positive dip angle 610. The beginning of the window 595 is offset from the well plan 570 and the window 595 has a negative dip angle 615. The use of windows having a consistent offset distance by an offset direction or changing direction/offset over a distance (defined by a dip angle) allows the wellbore to be positioned within a certain geology or formation, with the location of the formation being determined/confirmed as the BHA 170 drills through the formation. Similarly, the use of tolerance windows (formed by a plurality of LTWs) prevents, or at least reduces the instances of, the BHA 170 entering formations that may be positioned outside of the tolerance window. Thus in some embodiments, the steering module 215 determines at the step 545 if the proposed sliding instructions result in a steered projected BHA that is within the LTW that is defined by the offset direction, the offset distance, and/or the dip angle. The location-tolerance size and geometry define the shape of the LTW. In some embodiments, the LTW geometry coincides with at least a portion of a desired formation geometry through which the BHA 170 should extend through.

Referring back to FIGS. 5A-5C, at the step 502, the LTW and/or the OTW are defined at a projected distance. In some embodiments, the location-tolerance parameters and orientation-tolerance parameters, which are received at step 501, are used to define the LTW and OTW.

Figure 8:
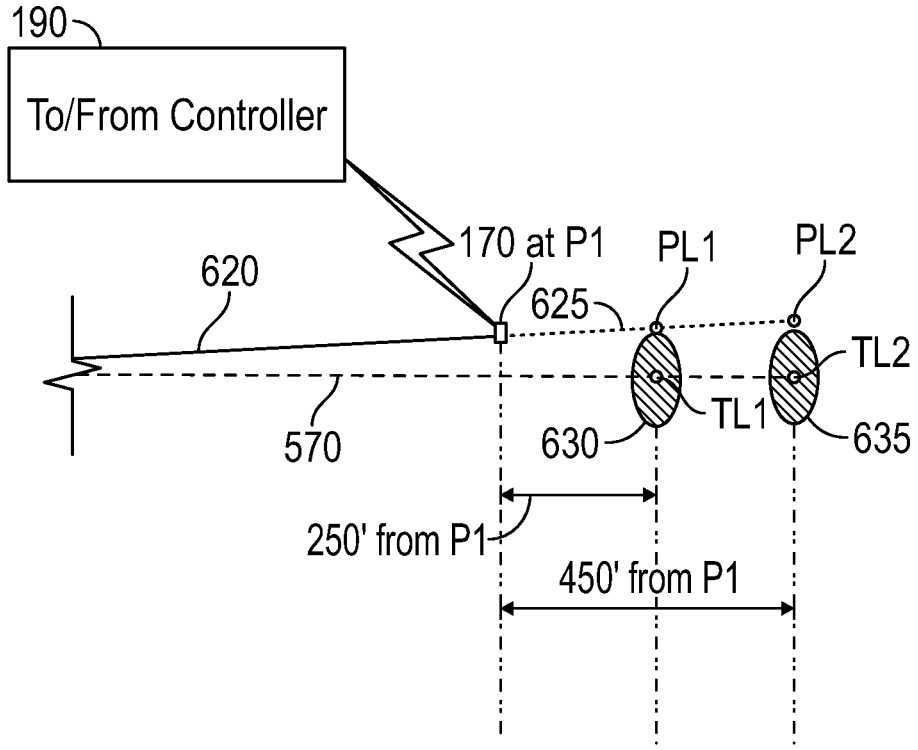
FIG. 8 is a diagrammatic illustration of the BHA during a step of the method of FIGS. 5A-5C, according to one or more aspects of the present disclosure.

Referring to FIG. 8 and at the step 503, a location P1 of the BHA 170 is identified using the steering module 215 and based on drilling operation information including feedback information. In some embodiments, the drilling operation information including feedback information includes data and/or information received from the BHA 170 during a standard static survey, and/or continuous data received from the BHA 170. Conventionally, a standard static survey is conducted at each drill pipe connection to obtain an accurate measurement of inclination and azimuth for the new survey position and continuous data is data received from the BHA 170 during drilling operations or at least between standard static surveys.

At the step 504, a first projected location and orientation of the BHA 170 at a first projected location PL1 is determined or identified by the steering module 215. Generally, the first projected location PL1 is approximately 250 ft. away from the location P1 of the BHA 170, but the distance may be any distance and is not limited to 250 ft.

At the step 505, the apparatus 100 determines if the first projected BHA location is within a first LTW at a first distance that is associated with the first projected location PL1. As illustrated in FIG. 8, the BHA 170 has created an actual drilling path 620, which can be compared to the target well plan 570. The steering module 215 determines whether the first projected BHA location PL1, which forms a portion of a projected drilling path 625, is within a first LTW 630 that is relative to a first target location TL1. In some embodiments, the first target location TL1 and the first projected location PL1 are spaced from the location P1 by approximately the same distance. In some embodiments, the first LTW 630 surrounds the first target location TL1. However, and as previously described, the entirety of the first LTW 630 may be offset from the first target location TL1.

Referring back to FIGS. 5A-5C, at the step 510 and when the first projected location is within the first LTW 630, the steering module 215 determines whether the projected inclination of the BHA 170 at the projected location PL1 is within the inclination-tolerance window associated with the projected location PL1.

At the step 515, it is determined whether the projected azimuth of the BHA 170 at the projected location PL1 is within an azimuth tolerance window associated with the projected location PL1.

At the step 520, rotary drilling continues without implementing sliding or rotary steering instructions.

If the first projected BHA location is not within the first LTW 630 at the first distance at step 505, then at the step 523, the steering module 215 determines a second projected location PL2 and orientation of the BHA 170 at the second projected distance. The step 523 is substantially similar to the step 504 except that the second projected distance is greater than the first projected distance. Generally, the second projected BHA PL2 (shown in FIG. 8) location is about 450 ft. ahead of the first location P1, but the distance may be any distance and is not limited to 450 ft.

At the step 525 and as illustrated in FIG. 8, the steering module 215 determines if the second projected BHA PL2 location is within a second LTW 635 at the second distance. The steering module 215 determines whether the second projected BHA location PL2 is within the second LTW 635 that is relative to the second target location TL2. In some embodiments, the second LTW 635 surrounds the second target location TL2.

At the step 530 and when the second projected BHA location PL2 is not within the second LTW 635, when the projected BHA inclination is not within the inclination-tolerance window, and/or when the projected BHA azimuth is not within the azimuth-tolerance window, the steering module 215 determines whether a proposed curvature used in sliding instructions will be calculated using a first method or a second method. In some embodiments, the first method is the TIA method. In some embodiments, the second method is the J method.

Generally, every proposed curvature is calculated using the TIA method, except for every third calculation, which is calculated using the J method.

At the step 535 and when the TIA method is used, the steering module 215 creates proposed sliding instructions based on the TIA method so that the steered projected BHA location and orientation is within the inclination-tolerance window, the azimuth-tolerance window, and the first LTW 630 at the first distance.

At the step 540 and when the J method is used, the steering module 215 creates proposed sliding instructions based on the J method so that the steered projected BHA position and orientation is within the inclination-tolerance window, the azimuth-tolerance window, and the second LTW 635 at the second distance. Generally, proposed sliding instructions include a target slide angle and a target slide length, such as 40° toolface azimuth for 45 ft.

At the step 545 and after the steering module 215 creates the proposed sliding instructions, the steering module 215 determines whether the proposed sliding instructions comply with the operating parameters. In some embodiments and during the steps 535 and 540, the steering module 215 creates proposed sliding instructions that result in a steered projected BHA that is within the LTW and the OTW, as defined by the LTW and OTW parameters, respectively. In other embodiments, the steering module 215 creates proposed sliding instructions that result in the steered projected BHA being within the LTW, and the steering module 215 determines whether the proposed sliding instructions result in the steered projected BHA 170 being within the OTW at the step 545. When the plurality of operating parameters includes the maximum slide distance, the steering module 215 determines at the step 545 whether the proposed sliding instructions include a proposed slide distance that exceeds the maximum slide distance. When the plurality of operating parameters includes the maximum dogleg severity, the steering module 215 determines at the step 545 if the proposed sliding instructions are associated with a projected, proposed dogleg severity that exceeds the maximum dogleg severity. When the plurality of operating parameters include a minimum radius of curvature, the steering module 215 determines if the proposed sliding instructions results in a proposed radius of curvature that is less than the minimum average rate of curvature. When the plurality of operating parameters includes the one or more unwanted downhole trend parameters, the steering module 215 determines if the proposed sliding instructions would result in a steered projected BHA that stops, counteracts, reduces, or reverses the unwanted trend that is at least partially defined by the unwanted downhole trend parameters. In some embodiments, there is a first set of operating parameters associated with a first formation type and a second set of operating parameters that is different from the first set of operating parameters, with the second set for a second formation type that is different from the first formation type. Thus, one or more of the operating parameters are applicable to one formation while different operating parameters are applicable to another formation. Based on the drilling operation information including feedback information and/or the well plan, the steering module 215 determines whether the BHA 170 is within either the first formation type or the second formation type and the determines whether the proposed steering instructions comply with the first set of operating parameters when the BHA 170 is within the first formation type or determines whether the proposed steering instructions comply with the second set of operating parameters when the BHA 170 is within the second formation type.

At the step 550 and when the proposed sliding instructions comply with the operating parameters, the proposed sliding instructions are published to the GUI 195 or to another location on a different device and/or are implemented using the steering module 215.

At the step 555, the steering module 215 alters the proposed sliding instructions to comply with the operating parameters. For example, when the plurality of operating parameters includes the maximum slide distance and the steering module determines that the proposed sliding instructions include a proposed slide distance that exceeds the maximum slide distance, then the steering module 215 alters the proposed sliding instructions so the altered proposed slide distance is equal to or less than the maximum slide distance. In some embodiments, the steering module 215 eliminates or delays a slide drill segment in order to comply with the maximum slide distance of zero. In other embodiments, the steering module 215 shortens the slide drill segment to a shortened, altered proposed slide distance in order to comply with the maximum slide distance that is greater than zero. When the plurality of operating parameters includes the maximum dogleg severity and the proposed sliding instructions result in a projected dogleg severity that is greater than the maximum dogleg severity, then the steering module 215 changes the target slide angle to an altered target slide angle that is less than the originally proposed slide angle in order to reduce the maximum dogleg severity. A similar process occurs with the minimum radius of curvature. When the plurality of operating parameters includes the one or more unwanted downhole trend parameters and when the steering module 215 determines that the proposed sliding instructions do not correct the unwanted trend, then the steering module 215 alters the proposed sliding instructions such that the unwanted downhole trend is reversed or reduced. For example and when the BHA 170 is within the LTW and the OTW yet the trend is that the BHA 170 drifting towards one boundary of either the LTW or the OTW, then the altered sliding instructions correct the drift towards the one boundary. Similarly, if the steering module 215 determines that the proposed sliding instructions results in a proposed projection that builds too fast, then the steering module 215 alters the proposed sliding instructions to reduce the build rate.

At the step 560, the altered proposed sliding instructions are published to the GUI 195 or to another location on a different device and/or are implemented using the steering module 215. That is, the steering module 215 controls the drilling equipment to steer the BHA 170 based on the altered steering instructions.

In some embodiments, the steering module 215 considers a historical success rate of the BHA 170 staying within the LTW and/or the OTW. The historical success rate may be measured as a percentage of distance travelled.

In some embodiments, the apparatus 100 or a portion of the apparatus 100 is a rotary steerable system and the proposed sliding instructions are replaced with proposed steering instructions implemented by a rotary steerable system during the method 500.

In some embodiments, any one of the plurality of inputs 220 may be altered or changed at any point during drilling operations and/or use of the apparatus 100.

In an example embodiment, the steps of the method 500 are automatically performed by the apparatus 100 without intervention by, or support from, a human user. In other embodiments, the altered sliding instructions and/or proposed altered drilling parameters are displayed on the GUI 195 for approval of the operator or user of the apparatus 100. In some embodiments, drilling equipment is any type or piece of equipment forming a portion of the apparatus 100.

In some embodiments, using the apparatus 100 and/or implementing a portion of the method 500 includes an ordered combination of steps (e.g., offsetting the LTW from the well plan 570) that results in the projected drill path 625 that is intentionally offset—in response to geological factors—from the well plan 570 without changing the well plan 570. This provides a particular, practical application of combining the use of geo-steering of the BHA 170 within a controlled distance from the well plan 570. For example, when the BHA 170 is in a generally horizontal orientation and when the well plan is modeled upon a desired formation extending at 91.2°, if, based on feedback information from the BHA 170 indicating that the formation tilts upwards at 91.8°, then the steering module 215 defines the LTW such that the projected drill path 625 extends within the desired formation. In some embodiments, the location-tolerance window parameters may be edited or altered such that the offset distance is 5' from the well plan 570 and/or the dip angle is 91.8°. This allows for the adjustment of the LTW in place of altering the entire well plan 570. In some embodiments, the steering module 215 identifies, based on the feedback data and/or the plurality of inputs 220, the difference between expected formation and actual formation and adjusts the location-tolerance widow parameters automatically in response to the determination of the difference.

In some embodiments, using the apparatus 100 and/or implementing a portion of the method 500 allows for automation of a process that is currently unable to be automated. Conventionally, and when a drilling operator is provided sliding instructions by a computer system, the drilling operator draws on his or her past experiences and the performance of the well to proximate how to alter the proposed sliding instructions. This is a very subjective process performed by the drilling operator, based on his or her judgment. In some instances, the alteration of the sliding instructions by the drilling operator is not optimal. As a result, any one or more is a result: the tortuosity of the actual wellbore is increased, which increases the difficulty of running downhole tools through the wellbore and increases the likelihood of damage to any future casing that is installed in the wellbore; a slide segment is performed in a formation type in which a slide segment should not be performed, which may result in non-essential wear to drilling tools or unpredictable/undesirable drilling directions; the number of sliding instances is increased due to inefficient drilling segments or other reasons, which can increase the time and cost of drilling to target; and the actual drilling path 620 does not interest or fall within the LTW and/or the OTW. Using the operating parameters during the method 500 and/or with the apparatus 100 automatically produces accurate, consistent, and/or optimal altered sliding instructions that decreases the tortuosity of the actual well plan; prevents a slide segment from being performed in a formation type in which a slide segment should not be performed; reduces the number of sliding instances due to increasing the efficiency of other drilling segments; and/or keeps the actual drilling path 620 with the LTWs and OTWs. As such, the operating parameters, which are rules, provide for automation of a drilling operation that currently relies on the subjective judgment of a drilling operator while also providing a superior product (e.g., the wellbore having less tortuosity and staying within the LTWs and OTWs).

Methods within the scope of the present disclosure may be local or remote in nature. These methods, and any controllers discussed herein, may be achieved by one or more intelligent adaptive controllers, programmable logic controllers, artificial neural networks, and/or other adaptive and/or "learning" controllers or processing apparatus. For example, such methods may be deployed or performed via PLC, PAC, PC, one or more servers, desktops, handhelds, and/or any other form or type of computing device with appropriate capability.

The term "about," as used herein, should generally be understood to refer to both numbers in a range of numerals. For example, "about 1 to 2" should be understood as "about 1 to about 2." Moreover, all numerical ranges herein should be understood to include each whole integer, or 1/10 of an integer, within the range.

Figure 9:
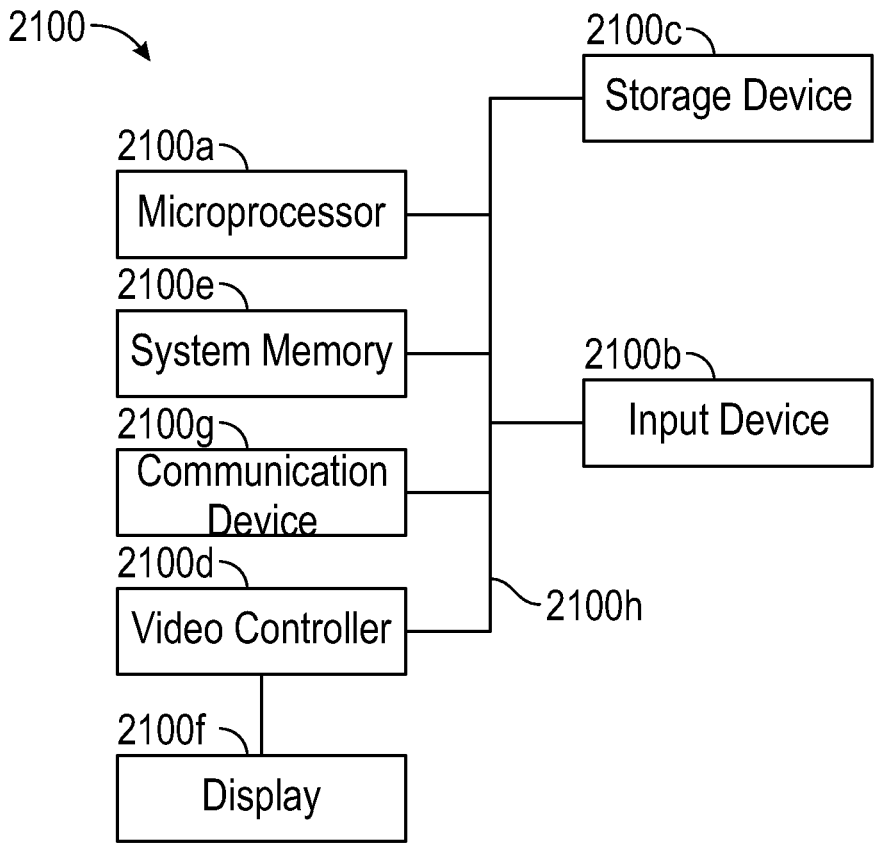
FIG. 9 is a diagrammatic illustration of a node for implementing one or more example embodiments of the present disclosure, according to an example embodiment.

In an example embodiment, as illustrated in FIG. 9 with continuing reference to FIGS. 1-8, an illustrative node 2100 for implementing one or more embodiments of one or more of the above-described networks, elements, methods and/or steps, and/or any combination thereof, is depicted. The node 2100 includes a microprocessor 2100*a*, an input device 2100*b*, a storage device 2100*c*, a video controller 2100*d*, a system memory 2100*e*, a display 2100*f*, and a communication device 2100*g* all interconnected by one or more buses 2100*h*. In several example embodiments, the storage device 2100*c* may include a floppy drive, hard drive, CD-ROM, optical drive, any other form of storage device and/or any combination thereof. In several example embodiments, the storage device 2100*c* may include, and/or be capable of receiving, a floppy disk, CD-ROM, DVD-ROM, or any other form of computer-readable non-transitory medium that may contain executable instructions. In several example embodiments, the communication device 2100*g* may include a modem, network card, or any other device to enable the node to communicate with other nodes. In several example embodiments, any node represents a plurality of interconnected (whether by intranet or Internet) computer systems, including without limitation, personal computers, mainframes, PDAs, and cell phones.

In several example embodiments, one or more of the controller 190, the GUI 195, the plurality of sensors 210, and the control systems 225, 230, and 235 includes the node 2100 and/or components thereof, and/or one or more nodes that are substantially similar to the node 2100 and/or components thereof.

In several example embodiments, one or more of controller 190, the GUI 195, the plurality of sensors 210, and the control systems 225, 230, and 235 includes or forms a portion of a computer system.

In several example embodiments, software includes any machine code stored in any memory medium, such as RAM or ROM, and machine code stored on other devices (such as floppy disks, flash memory, or a CD ROM, for example). In several example embodiments, software may include source or object code. In several example embodiments, software encompasses any set of instructions capable of being executed on a node such as, for example, on a client machine or server.

In several example embodiments, a database may be any standard or proprietary database software, such as Oracle, Microsoft Access, SyBase, or DBase II, for example. In several example embodiments, the database may have fields, records, data, and other database elements that may be associated through database specific software. In several example embodiments, data may be mapped. In several example embodiments, mapping is the process of associating one data entry with another data entry. In an example embodiment, the data contained in the location of a character file can be mapped to a field in a second table. In several example embodiments, the physical location of the database is not limiting, and the database may be distributed. In an example embodiment, the database may exist remotely from the server, and run on a separate platform. In an example embodiment, the database may be accessible across the Internet. In several example embodiments, more than one database may be implemented.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," "front-to-back," etc., are for the purpose of illustration only and do not limit the specific orientation or location of the structure described above.

In several example embodiments, one or more of the operational steps in each embodiment may be omitted or rearranged. For example, the step 515 may occur prior to or simultaneously with the step 510. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those of ordinary skill in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method of slide drilling which comprises:

determining, by a surface steerable system and based on drilling operation information including feedback information, a location of a bottom hole assembly ("BHA") in a wellbore;

determining, by the surface steerable system and using the location of the BHA, a first projected location of the BHA at a first projected distance;

determining if the first projected location is within a first location-tolerance window associated with the first projected distance;

in response to determining that the first projected location is not within the first location-tolerance window associated with the first projected distance, determining, by the surface steerable system and using the location of the BHA, a second projected location of the BHA at a second projected distance;

wherein the first projected distance is less than the second projected distance;

in response to determining that the first projected location is not within the first location-tolerance window associated with the first projected distance, determining if the second projected location is within a second location-tolerance window associated with the second projected distance;

creating using the surface steerable system, proposed steering instructions that result in a proposed, projected BHA location being within the second location-tolerance window that is associated with the second projected distance;

wherein creating the proposed steering instructions is in response to the first projected location not being within the first location-tolerance window and to the second projected location not being within the second location-tolerance window;

determining whether the proposed steering instructions comply with a plurality of operating parameters, wherein the plurality of operating parameters comprises a maximum slide distance;

altering, by the surface steerable system, when the proposed steering instructions do not comply with the plurality of operating parameters, the proposed steering instructions to comply with the plurality of operating parameters; and implementing the altered steering instructions, using the surface steerable system, to drill a wellbore.

2. The method of claim 1, wherein the maximum slide distance is zero.

3. The method of claim 1, wherein the plurality of operating parameters further comprises a maximum dogleg severity; and wherein determining whether the proposed steering instructions comply with the plurality of operating parameters comprises determining whether the proposed steering instructions result in a proposed dogleg severity that is greater than the maximum dogleg severity.

4. The method of claim 1, wherein the plurality of operating parameters further comprises a shape of the second location-tolerance window and a size of the second location-tolerance window; and wherein the second location-tolerance window is defined by the shape of the second location-tolerance window and the size of the second location-tolerance window.

5. The method of claim 1, wherein the plurality of operating parameters further comprises an offset distance of the second location-tolerance window relative to a target path; and wherein the second location-tolerance window is offset from the target path by the offset distance at the second projected distance.

6. The method of claim 5, wherein the plurality of operating parameters further comprises an offset direction of the second location-tolerance window relative to the target path; and wherein the second location-tolerance window is offset from the target path in the offset direction at the second projected distance.

7. The method of claim 1, wherein the plurality of operating parameters further comprises an orientation-tolerance window comprising an inclination range and an azimuth range.

8. The method of claim 7, which further comprises:

determining, by the surface steerable system and based on the drilling operation information including the feedback information, an orientation of the BHA at the location;

determining, using the location and the orientation of the BHA, a projected BHA orientation at the second projected distance; and determining if the projected BHA orientation is within the orientation-tolerance window at the second projected distance;

wherein creating the proposed steering instructions that result in the proposed, projected BHA location being within the second location-tolerance window associated with the second projected distance is in further response to the proposed, projected BHA orientation not being within the orientation-tolerance window at the second projected distance; and wherein the proposed steering instructions also results in the proposed, projected BHA orientation being within the orientation-tolerance window that is associated the second projected distance.

9. The method of claim 1, wherein the plurality of operating parameters further comprises unwanted downhole trend parameters that identify an unwanted downhole trend;

wherein the method further comprises:

identifying, by the surface steerable system and based on the drilling operation information including the feedback information, an unwanted trend defined by the unwanted downhole trend parameters;

wherein determining that the proposed steering instructions do not comply with the plurality of operating parameters comprises determining that the proposed steering instructions are not associated with a reduction of the unwanted trend; and wherein altering the proposed steering instructions to comply with the plurality of operating parameters results in altered steering instructions that reduce the unwanted trend.

10. The method of claim 9, wherein the unwanted downhole trend comprises any one of: a trend associated with equipment output; a geological related trend; and a downhole parameter trend.

11. The method of claim 1, wherein the plurality of operating constraints comprise:

a first set of operating constraints associated with a first formation type; and a second set of operating constraints that are different from the first set of operating constraints and that are associated with a second formation type that is different from the first formation type;

wherein the method further comprises determining, by the surface steerable system and based on the drilling operation information including feedback information, that the location of BHA is within either the first formation type or the second formation type; and wherein altering, by the surface steerable system, the proposed steering instructions to comply with the plurality of operating constraints comprises altering the proposed steering instructions to comply with the first set of operating constraints when the location of the BHA is within the first formation type and altering the proposed steering instructions by the surface steerable system, to comply with the second set of operating constraints when the location of the BHA is within the second formation type.

12. An apparatus adapted to drill a wellbore comprising:

a bottom hole assembly ("BHA") comprising at least one measurement while drilling instrument; and a controller communicatively connected to the BHA and configured to:

determine, based on drilling operation information including feedback information received from the BHA, a location of the BHA;

determine, using the location of the BHA, a first projected location of the BHA at a first projected distance;

determine if the first projected location is within a first location-tolerance window associated with the first projected distance;

in response to determining that the first projected location is not within the first location-tolerance window associated with the first projected distance, determine, using the location of the BHA, a second projected location of the BHA at a second projected distance;

in response to determining that the first projected location is not within the first location-tolerance window associated with the first projected distance, determine if the second projected location is within a second location-tolerance window associated with second first projected distance;

create, in response to the first projected location not being within the first location-tolerance window and to the second projected location not being within the second location-tolerance window, proposed steering instructions that result in a proposed, projected BHA location being within the second location-tolerance window that is associated with the second projected distance;

determine whether the proposed steering instructions comply with a plurality of operating parameters, wherein the plurality of operating parameters comprises a maximum slide distance;

alter, when the proposed steering instructions do not comply with the plurality of operating parameters, the proposed steering instructions to comply with the plurality of operating parameters; and implement the altered steering instructions to drill a wellbore.

13. The apparatus of claim 12, wherein the maximum slide distance is zero.

14. The apparatus of claim 12, wherein the plurality of operating parameters further comprises a maximum dogleg severity; and wherein the controller is further configured to determine whether the proposed steering instructions result in a proposed dogleg severity that is greater than the maximum dogleg severity.

15. The apparatus of claim 12, wherein the plurality of operating parameters further comprises a shape of the second location-tolerance window and a size of the second location-tolerance window; and wherein the second location-tolerance window is defined by the shape of the second location-tolerance window and the size of the second location-tolerance window.

16. The apparatus of claim 12, wherein the plurality of operating parameters further comprises an offset distance of the second location-tolerance window relative to a target path; and wherein the second location-tolerance window is offset from the target path by the offset distance at the second projected distance.

17. The apparatus of claim 16, wherein the plurality of operating parameters further comprises an offset direction of the second location-tolerance window relative to the target path; and wherein the second location-tolerance window is offset from the target path in the offset direction at the second projected distance.

18. The apparatus of claim 12, wherein the plurality of operating parameters further comprises an orientation-tolerance window comprising an inclination range and an azimuth range.

19. The apparatus of claim 18, wherein the controller is further configured to:

determine, based on drilling operation information including feedback information received from the BHA, an orientation of the BHA at the location;

determine, using the location and the orientation of the BHA, a projected BHA orientation at the second projected distance; and determine if the projected BHA orientation is within the orientation-tolerance window at the second projected distance;

wherein the proposed steering instructions also result in the proposed, projected BHA orientation being within the orientation-tolerance window that is associated the second projected distance.

20. The apparatus of claim 12, wherein the plurality of operating parameters further comprises unwanted downhole trend parameters that identify an unwanted downhole trend;

wherein the controller is further configured to:

identify, based on drilling operation information including feedback information received from the BHA, an unwanted trend defined by the unwanted downhole trend parameters;

determine that the proposed steering instructions are not associated with a reduction of the unwanted trend; and alter the proposed steering instructions to reduce the unwanted trend.

21. The apparatus of claim 20, wherein the unwanted downhole trend comprises any one of: a trend associated with equipment output; a geological related trend; and a downhole parameter trend.

22. The apparatus of claim 12, wherein the plurality of operating constraints comprise:

a first set of operating constraints associated with a first formation type; and a second set of operating constraints that are different from the first set of operating constraints and that are associated with a second formation type that is different from the first formation type;

wherein the controller is further configured to, based on drilling operation information including feedback information received from the BHA, determine whether the location of BHA is within either the first formation type or the second formation type; and wherein the controller is further configured to alter the proposed steering instructions to comply with the first set of operating constraints when the location of the BHA is within the first formation type and alter the proposed steering instructions to comply with the second set of operating constraints when the location of the BHA is within the second formation type.

* * * * *